United States Patent [19]

Cross

[11] 4,248,464

[45] Feb. 3, 1981

[54] LOG HANDLING FORK

[76] Inventor: Eston F. Cross, 6201 Robertson Ave., Nashville, Tenn. 37209

[21] Appl. No.: 110,352

[22] Filed: Jan. 7, 1980

[51] Int. Cl.[3] ..... A47F 13/08

[52] U.S. Cl. ..... 294/9

[58] Field of Search ..... 294/9, 10, 11, 12, 49, 294/50.5, 55; 15/257.3; 16/110 R; 53/390; D7/104

[56] References Cited

U.S. PATENT DOCUMENTS

| | | | |
|---|---|---|---|
| 809,807 | 1/1906 | Jewett | 294/49 |
| 3,042,438 | 7/1962 | Turner | 294/11 |
| 4,194,778 | 3/1980 | Hodnett | 294/55 |

*Primary Examiner*—James B. Marbert

*Attorney, Agent, or Firm*—Harrington A. Lackey

[57] ABSTRACT

A log handling device having a pair of log supporting tines and a rearward extending handle portion connected to the tines by a raised intermediate handle portion including a transverse handle member spaced behind and above the rear ends of the tines, the raised intermediate portion forming a stop to limit the rearmost position of a log carried by the tines.

6 Claims, 4 Drawing Figures

LOG HANDLING FORK

This invention relates to a log handling apparatus, and more particularly to a log handling fork.

Forks and shovels of various designs are well known in the art.

The closest prior art known to the applicant are the following U.S. patents:

U.S. Pat. No. 275,130 Brown Apr. 3, 1883

U.S. Pat. No. 845,592 Stewart Feb. 26, 1907

U.S. Pat. No. 1,046,974 Church Dec. 10, 1912

U.S. Pat. No. 3,136,574 Pasquale June 9, 1964

The above Brown Pat. No. 275,130, merely discloses a fork device for handling glassware including a pair of tines connected to an elongated rearwardly extending handle.

The Stewart U.S. Pat. No. 845,592 discloses a shovel including a conventional rear handle and a raised longitudinally extending intermediate handle.

The Church U.S. Pat. No. 1,046,974 discloses a shovel including forward projecting tines with an upward turned, elongated handle member.

The Pasquale U.S. Pat. No. 3,136,574 discloses a snow shovel having an elongated U-shaped handle including a transverse rear handle and a transverse intermediate handle.

SUMMARY OF THE INVENTION

It is an object of this invention to provide an especially constructed fork for handling or carrying a large log endwise upon a pair of parallel tines, but particularly for loading the log into the narrow firedoor opening of a wood burning stove.

The specific fork is made of a single piece of rod stock bent into a U-shaped body member in which the leg portions of the body member extend substantially parallel throughout their length and terminate in a pair of parallel log-carrying tines. The space between the tines is, of course, less than the transverse dimension of the smallest log desired to be handled by the fork device. Between the tines and the elongated rear handle portion, the rod stock is bent upwardly to form arcuate raised rod portions convex upward, which are bridged by an intermediate transverse handle member or bar. This transverse handle member is spaced rearwardly and above the rear ends of the tines which join the front end portions of the arcuate rod portions. The intermediate arcuate rod portions provide a stop to limit the rearmost position of the log carried by the tines. The intermediate transverse handle member is located as far forward as possible, yet is spaced sufficiently behind the rear end of the log in its rearmost position to provide clearance between the log and the hand of the operator grasping the intermediate handle member.

The U-shaped rod construction provides a pair of rod elements extending throughout the body member of the fork to provide transverse strength and to stabilize the body member of the fork against twisting.

The intermediate transverse handle member also holds the elongated leg portions of the body member substantially rigid and parallel, closely adjacent to the tines to prevent them from spreading under the load of a log carried by the tines.

The transversely spaced rod elements, as well as the transverse intermediate handle bar, gives the operator better control in handling the fork, particularly when carrying the heavy load of a large log.

The intermediate transverse handle bar is located approximately mid-way between the rear handle member, formed by the bight of the U-shaped rod stock, and the free ends of the tines in order to give adequate leverage for handling the heavy load carried by the tines.

DESCRIPTION OF THE PREFERRED EMBODIMENTS

Figure 1:
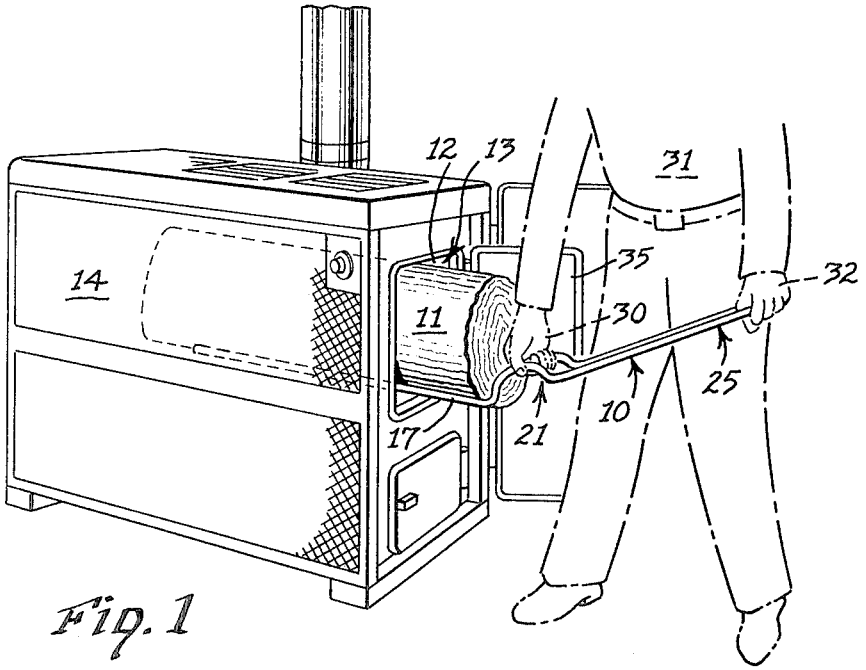
FIG. 1 is a side perspective view of the log handling fork in the hands of the operator, loaded with a large log as the log is being introduced into the firebox of a wood-burning stove.

Referring now to the drawings in more detail, the fork device 10 made in accordance with this invention is particularly constructed and adapted to handle or carry a large log 11. The fork device 10 is particularly adapted to carry and load a log 11 through the normally small firedoor opening 12 into the combustion chamber 13 of a wood-burning stove 14, as best disclosed in FIG. 1.

Figure 2:
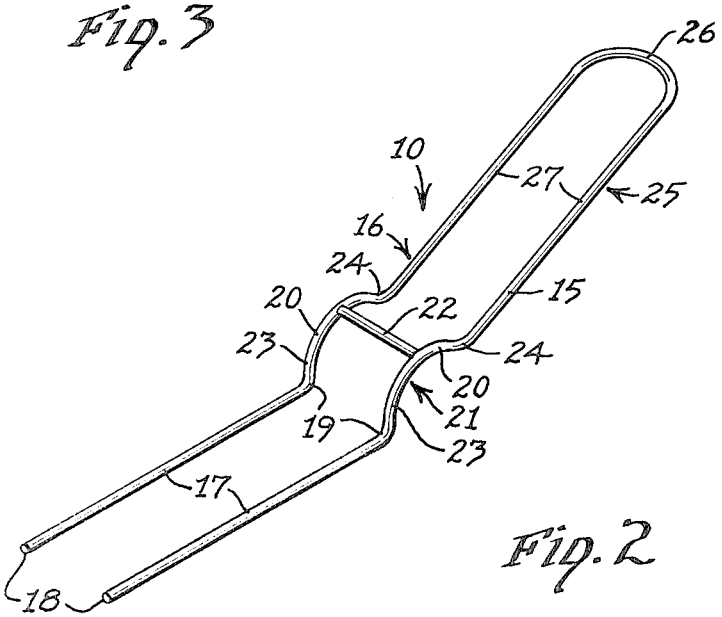
FIG. 2 is a top front perspective view of the log handling fork.

The fork device 10 is preferably made of single piece of rod stock 15 bent into a U-shape, similar to a large hairpin, as best disclosed in FIG. 2, to form the body member 16 of the fork device 10.

The body member 16 generally comprises a front end portion including a pair of parallel log-carrying tines 17 having free ends 18 and rear ends 19. The rod stock 15 from which the tines 17 are formed are bent at the rear ends 19 to merge into a pair of upward convex, arcuate rod elements 20, forming the intermediate handle portion 21. The top portions of the curves of the arcuate rod elements 20 are bridged and connected, such as by welding, to the opposite ends of an intermediate handle bar or handle member 22, which extends transversely of the vertical longitudinal axial plane of the body member 16, or transversely of the longitudinal axes of the tines 17.

The forward, downward sloping portions 23 of the arcuate rod elements 20, which merge with the rear ends 19 of the tines 17, form a rear stop for abutting against the rear end of a log 11 in its rearmost position (FIGS. 1 and 3), thereby limiting the rearward movement of the log 11 on the tines 17.

The rod stock 15 forming the rear portion of the arcuate rod elements 20 are bent to join the rear end portion 25 of the body member 16.

The rear end portion 25 includes the rear handle member 26 formed by the bight in the U-shaped body member 16, and the straight parallel rear rod elements 27 joining the bent portions 24.

Figure 4:
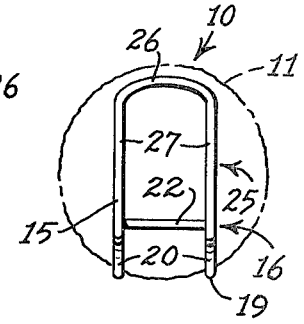
FIG. 4 is a rear elevation of the log handling fork illustrating a log, in phantom, carried by the tines.

The rod elements 27, 20 and the tines 17 are substantially parallel throughout their length, or in other words, lie in parallel vertical planes, as illustrated in FIG. 4. These parallel rod elements are held in their parallel positions by the rear handle member 26 and the intermediate handle bar 22, as well as the inherent rigidity of the rod stock 15, preferably steel.

Figure 3:
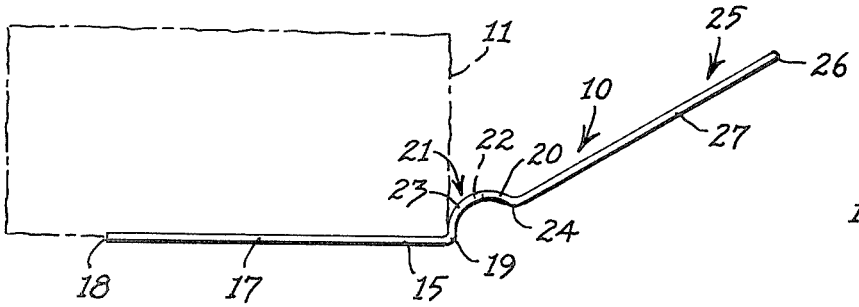
FIG. 3 is a side elevation of the log handling fork supporting a log in phantom, in its rearmost position upon the tines.

It will be noted, particularly in FIGS. 1 and 3, that the transverse handle bar 22 is located above and behind the rear ends 19 of the tines 17. The spacing between the intermediate handle bar 22 and the rear end of the log 17 is sufficient to permit one hand 30 of the operator 31 to securely grasp the intermediate handle bar 22, without the log 11, in its rearmost position on the tines 17, engaging, scraping or crushing the hand 30 of the operator 31. The other hand 32 of the operator 31 securely grasps the rear handle member 26, as best illustrated in FIG. 1.

The substantial length of the rear end portion 25, which approximates the length of the tines 17, gives the operator 31 ample leverage, with his rear hand 32, to easily lift and handle the weight of the log 11 supported in its rearmost position on the tines 17, as disclosed in FIGS. 1 and 3.

The tines 17 are, of course, spaced apart a distance less than the diameter, or the transverse dimension, of the log 11, so that the log 11 is properly cradled upon the tines 17.

In the operation of the fork device 10, the operator 31 opens the door 35 to the firedoor opening 13. If a log is needed, the operator lays the device 10 upon the floor, and places the log 11 upon the tines 17 in the rearmost position, as disclosed in FIG. 1. Or, the operator 31 may insert the tines 11 beneath a log in a log pile, moving the tines 17 beneath the log until the rear end of the log 11 abuts against the rear ends 19. He then lifts the log 11 by grasping with his front hand 30 the transverse bar 22, and his rear hand 32 the rear handle member 26. He then carries the log and thrusts the free ends 18 of the tines 17 into the firedoor opening 13, to insert the log 11 into the combustion chamber 13, as illustrated in FIG. 1. After the log 11 is completely within the combustion chamber 13, the fork device 10 is then withdrawn from beneath the log 11.

If difficulty is experienced in removing the tines 11 from the bottom of the heavy log 11, the body member 16 may be twisted or turned by manipulating the intermediate handle bar 22 and the handle member 26, to rock or tilt, and hence dump, the log 11 into the combustion chamber or fire box 13. This movement is facilitated by the double, parallel rod structure, which facilitates rotating the body member 16 about its own longitudinal axis, without excessive stress or torsional stresses upon the material of the rod stock 15, and without unduly straining the hande 30 and 32 of the operator 31. After the fork device 10 is removed from the combustion chamber 13, the door 35 is closed.

The fork device 10 is a considerable improvement over loading large logs 11 into the fire door opening 12 by hand, and substantially safer. Furthermore, the fork device 10 is a substantial improvement over other known devices which might be utilized for introducing a large log 11 into the wood stove 14, such as a shovel, a fabric log sling, or tongs.

What is claimed is:

1. A fork device for handling a log comprising:

(a) an elongated body member including a front portion, an intermediate handle portion, and a rear handle portion, (b) said front portion consisting of a pair of longitudinally extending parallel tines having rear ends and spaced apart a distance less than the cross-sectional dimension of a log adapted to be received longitudinally upon said tines, (c) said intermediate handle portion comprising a handle bar member extending transversely of the longitudinal axes of said tines, (d) said handle bar member being spaced above and behind the rear ends of said tines, sufficiently to provide clearance between an operator's hand grasping said handle bar member and a log in its rearmost position on said tines, (e) said rear handle portion having a rear handle member spaced behind said transverse handle bar member sufficiently to provide adequate leverage counterbalancing the load of a log seated on said tines when the operator's other hand grasps said rear handle member.

2. The invention according to claim 1 in which said intermediate handle portion comprises stop means at the rear ends of said tines to limit the rearmost position of a log carried by said tines.

3. The invention according to claim 2 in which said stop means comprises a part of said intermediate handle portion integrally connected to said rear ends of said tines and rising above the plane of said tines.

4. The invention according to claim 3 in which said elongated body member is formed of U-shaped rod stock, the bight of said U-shaped rod stock forming said rear handle member, and the free end portion of said rod-stock forming said tines, said intermediate handle portion comprising upward convex arcuate rod elements, said handle bar member bridging the upper portions of said arcuate rod elements.

5. The invention according to claim 4 in which said rear handle portion projects upward and rearward from said arcuate rod elements at an angle to the plane of said tines.

6. The invention according to claim 5 in which the leg portions of said U-shaped rod stock are continuously parallel throughout said elongated body member.

* * * * *